US007251857B2

(12) United States Patent
Caruso

(10) Patent No.: US 7,251,857 B2
(45) Date of Patent: Aug. 7, 2007

(54) VERSATILE TOOLS

(76) Inventor: Steven Jerome Caruso, 862 Pine Hill Dr., Antioch, IL (US) 60002

( * ) Notice: Subject to any disclaimer, the term of this patent is extended or adjusted under 35 U.S.C. 154(b) by 555 days.

(21) Appl. No.: 10/731,976

(22) Filed: Dec. 10, 2003

(65) Prior Publication Data

US 2004/0134023 A1 Jul. 15, 2004

Related U.S. Application Data

(60) Provisional application No. 60/439,706, filed on Jan. 13, 2003, provisional application No. 60/432,185, filed on Dec. 10, 2002.

(51) Int. Cl.
*A47L 5/26* (2006.01)
*A47L 9/04* (2006.01)

(52) U.S. Cl. ..... 15/377; 15/387

(58) Field of Classification Search ..... 15/344, 15/377, 387

See application file for complete search history.

(56) References Cited

U.S. PATENT DOCUMENTS

| | | | | |
|---|---|---|---|---|
| 500,415 | A | 6/1893 | Neal | |
| 922,225 | A * | 5/1909 | Wegner | 15/344 |
| 1,764,626 | A | 6/1930 | Heckman | |
| 2,078,634 | A | 4/1937 | Karlstrom | |
| 2,205,599 | A | 6/1940 | Mitchell | |
| 2,246,036 | A * | 6/1941 | Farrell | 15/387 |
| 2,671,926 | A | 3/1954 | Minerly | |
| 2,777,152 | A * | 1/1957 | Cosentino | 15/387 |
| 3,060,485 | A | 10/1962 | Butter et al. | |
| 4,357,730 | A * | 11/1982 | Lex | 15/344 |
| 4,445,245 | A * | 5/1984 | Lu | 15/23 |
| 4,454,627 | A | 6/1984 | Simm et al. | |
| 5,331,716 | A | 7/1994 | Hemmann et al. | |
| 2001/0054214 | A1 | 12/2001 | Kalman et al. | |
| 2006/0179605 | A1 * | 8/2006 | Greene | 15/377 |

* cited by examiner

*Primary Examiner*—Terrence R. Till
(74) *Attorney, Agent, or Firm*—McAndrews, Held & Malloy Ltd.

(57) ABSTRACT

One embodiment of the present invention concerns novel end effectors that may incorporate hexagonal drive shafting and are particularly well suited to be used as scrubbing/abrasive or wiping elements for the cleaning of surfaces. Another embodiment of the present invention is a tool that can wipe and scrub a surface to be cleaned and dry the same surface. Yet another embodiment of the present invention is a tool or a kit of tools that can be adapted to either wipe or scrub a surface or the tool may be adapted to accomplish other tasks such as acting as a power screw driver, power nut-driver, power hand drill, power sander, etc. And yet another embodiment is a novel powered device that serves as a duster.

25 Claims, 15 Drawing Sheets

VERSATILE TOOLS

CROSS-REFERENCE TO RELATED APPLICATIONS

This application claims priority from U.S. application Ser. No. 09/963,954 filed Sep. 26, 2001, now abandoned, and from provisional application Ser. No. 60/235,658 filed Sep. 26, 2000, and from provisional application Ser. No. 60/432,185 filed Dec. 10, 2002, and from provisional application Ser. No. 60/439,706 filed Jan. 13, 2003. Each application referred to in this paragraph is incorporated here by reference.

FIELD OF THE INVENTION

The present invention relates generally to tools used in maintenance and in the treatment of surfaces and the cleaning and collection of debris from a variety of surfaces. Such tools may range from scrubbing pads, to dusters to bits which drive fasteners and to motor-driven-power heads for driving these tools.

BACKGROUND OF THE INVENTION

The present invention relates to the cleaning and treating of various surfaces. The invention also relates to a power tool for accomplishing common maintenance tasks. Many tools have been created to clean, and there have also been many tools created to help accomplish common maintenance tasks ranging from drilling holes to driving fasteners. The result has been that the end user has had to have a great many of these individual tools in order to accomplish all of the aforementioned tasks. And so one object of the invention is to reduce the number of cleaning and maintenance tools by enabling a common interface between a power unit and its driven accessories. Another object of the invention is to create new and novel ways of cleaning surfaces. While there have been a multitude of tools to clean our environments there are serious limitations, as the solutions to date have been manual, limited in cleaning capacity, and lacking the advantages and efficiency that automation brings to most tasks. And yet another object of the invention is that various elements of the disclosed invention may be combined to form consolidated kits of tools for consumers.

BRIEF SUMMARY OF THE INVENTION

The present invention relates to enabling a common interface between a power unit and its driven accessories, thereby reducing the number of power units that a consumer needs to possess in order to accomplish a great variety of tasks. These tasks range from scrubbing a surface to driving fasteners to drilling holes. So to accomplish some tasks the user will be able to couple a scrubbing pad to a power unit, while for other tasks the user will be able to couple a bit to the same power unit. In order to enable this common interface between all tools, design provisions are made to make such a coupling manufacturable, economical, and one which may or may not be selectively lockable. Another embodiment of the present invention relates to making a handheld tool, which is particularly well suited to the scrubbing and wiping/drying of a surface. The device includes an endless surface, a shear, a drive control, a handle and may be used alone or in conjunction with other cleaning implements such as spray bottles or steamers. Yet another embodiment of the invention relates to a hand-held powered apparatus for the dusting of surfaces. The device includes a motive power source, a dusting head or brush which is powered by the motive power source, and a method of cleaning the dusting head or brush when at least a part of the dusting head or brush is not in contact with the surface to be cleaned.

LIST OF REFERENCE CHARACTERS

Figure 1:
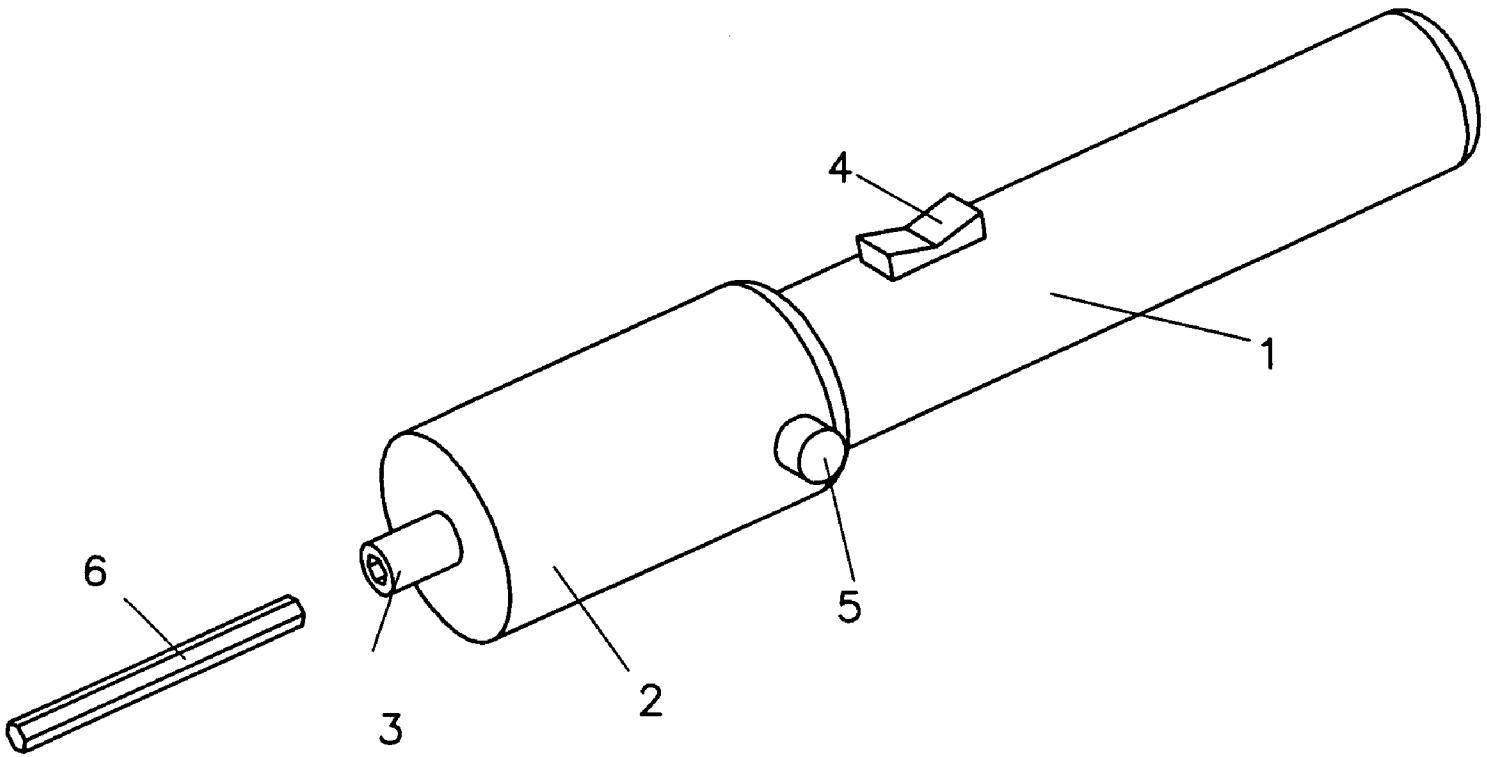
FIG. 1 is a trimetric view of one embodiment of the invention.

List of reference characters used in the drawings, like characters indicate like parts:

1) First body member of the tool.
2) Second body member of the tool.
3) Rotatable shaft
4) Power switch
5) Release button
6) Hexagonal shafting
7) Tank
8) An endless scrubbing/abrasive surface
9) Flexed/creased area of 8
10) Hexagonal section
11) Backing plate
12) Scrubbing pad-element
13) Scrubbing brushes/bristles
14) Locking recess
15) Interface cup.
16) Vacuum conduit
17) Air inlet holes/aperture(s)
18) Conduit orifice/air outlet
19) Shield
20) Fibrous brush-duster
21) Locking tab
22) Finger grip

23) Locking tooth/tab/pawl
24) Exterior locking feature/groove of 3
25) A face of 16
26) Baffle
27) Reduction drive unit
28) Bleeder valve
29) Swivel caps of 31
30) Center Swivel of 16
31) Tubular body
32) Light source
33) Air turbine
34) Motor
35) Feathers
36) Lambswool

DETAILED DESCRIPTION OF THE INVENTION

While the invention will be described in connection with several preferred embodiments, it will be understood that the invention is not limited to these embodiments. On the contrary, the invention includes all alternatives, modifications, and equivalents as may be included within the spirit and scope of the appended claims.

While much of the specification may refer to a tool with many functions, it should be appreciated that any of these individual functions could occur as an independent tool. And so several tools are contemplated in addition to a multifunction, versatile tool. So those features that have been disclosed such as a pivoting handle particular type of shafting i.e. hex etc, should not be viewed as limiting, on the contrary they are the opposite. And so such features may or may not be incorporated into each of the individual embodiments. Additionally, individual features of separate embodiments may be re-combined in various ways.

Figure 2:
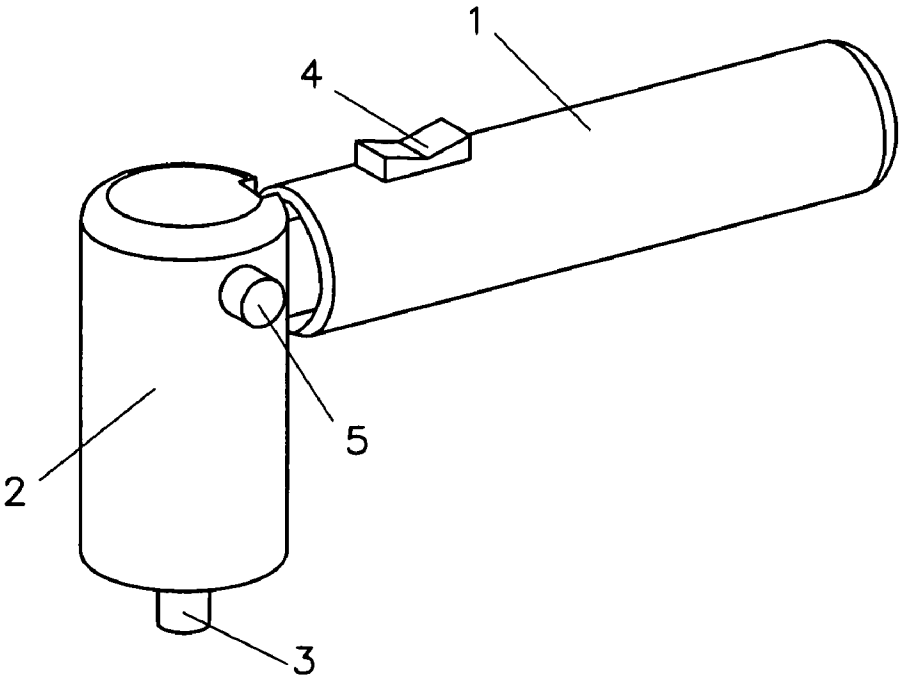
FIG. 2 is a trimetric view of another embodiment of the invention.

Referring to FIG. 1 one embodiment of the present invention may be seen. In this figure the tool may act much like what is commonly known as a cordless screwdriver. The main unit has a first body, and a second body 2. It is common to combine these two sections into a single unit, which may be desirable for some embodiments, however in this preferred embodiment, these two bodies 1 and 2, are rotatable relative to each other. The central portion of body 1 generally defines a handgrip area. A release button 5 may be used to release and lock the bodies 1, and 2 relative to each other in a multitude of positions relative to each other. Release button 5, also generally indicates the axis or rotation of body 1 and 2 relative to each other. Referring to FIG. 2, a second contemplated position can be seen, and FIG. 3 shows yet another contemplated position of body 1 and 2 relative to each other.

Again referring to FIG. 1, the bodies 1 and 2 may house batteries in a battery compartment (or the unit could be in electrical communication with a separate power source) and a motor and a drive train, which can power rotatable shaft 3. A switch 4, may be used to control the current to the motor from the batteries and may further allow for the final rotation of shaft 3 to be reversible, in other words the user may be able to control the direction of rotation of shaft 3. This is useful in many applications ranging from driving fasteners in and out, to using a cleaning element that has a directional bias, to increasing the access of a cleaning element into confined areas, in other words, the user may want to control and thus change the direction of rotation in order to wipe/brush dirt-debris-fluid out of an area/crevice/crack rather than push it into the area/crevice/crack. The unit may also include a clutch for selectively locking shaft 3 from the motor and its associated gearing. This is useful if one wants to start or finish a driving/drilling operation by hand and not transmit the forces from the bit back to the motor. Such a clutch could be selectively activated by the user, or could be accomplished with a more automatic clutch arrangement. One such type of automatic clutch under consideration for this application is a sprag clutch. Shaft 3, can have several interfaces for selectively attaching tools. As previously mentioned, in a preferred embodiment, a hex shaft such as illustrated by 6 is contemplated for the end-effectors and so a hexagonal hole 8, may be provided into the shaft 3. This hole may be provided with several known retention means for securely holding the hex shafts of the end effectors. A magnet may be present within the hole of shaft 3 for securing ferrous hexagonal shafting. Alternatively, or additionally, a securing means of various configurations may be provided in association with shaft 3 for engagement with locking recess 14, of an end effector as best seen by referring to FIGS. 7 and 8. As mentioned several methods possible for achieving this lock ability are known in other industries. One such method is to use a frictional member, such as a spring wire, which is disposed within the hex shank hole of the shaft 3. This results in a relatively low locking force, but is sufficient for some applications. Another such method is to have a ball bearing or other such feature disposed within the hex shank hole of the shaft 3. This ball or feature is often spring loaded to actively engage a locking recess similar to 14. Other times this ball or feature may be actively retracted or engaged by the user to actively engage a locking recess similar to 14, by the user sliding a collar, or other such activation device. In any case, it is anticipated that it may be desirable to offer some means to lock the end effector onto the rotatable shaft 3 in a more positive way than friction alone may provide.

Figure 3:
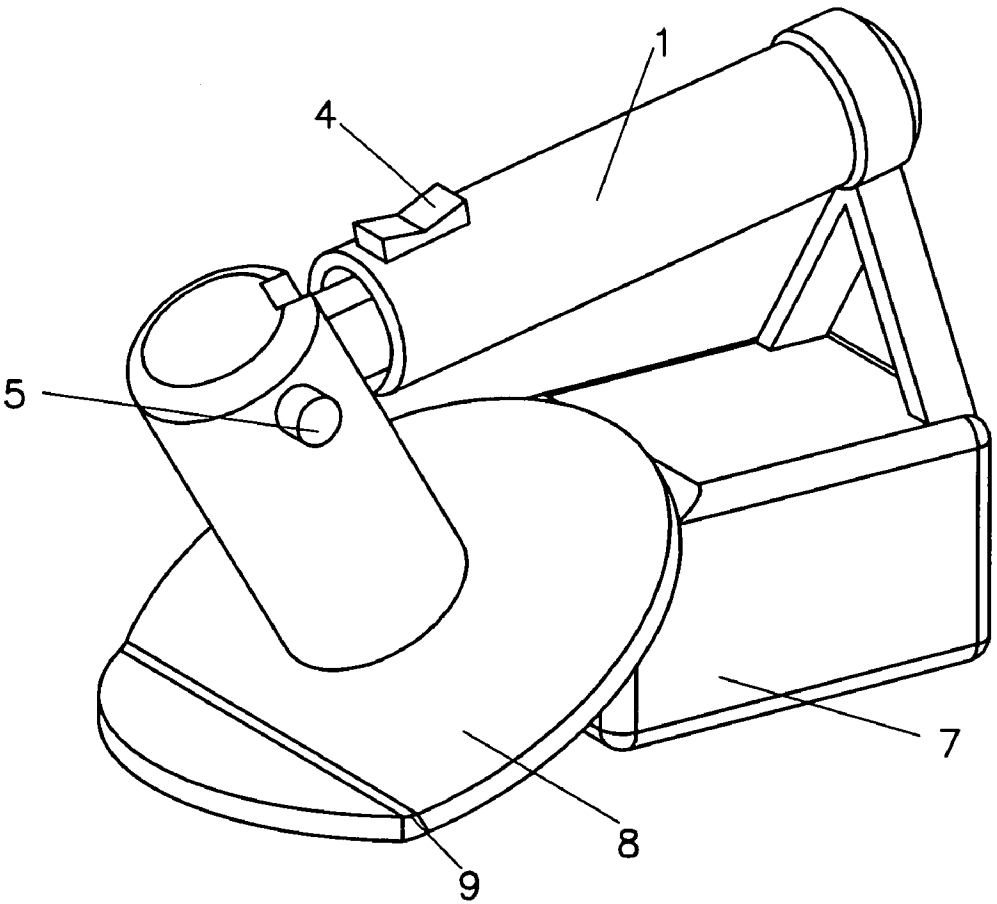
FIG. 3 is a trimetric view of another embodiment of the invention.

FIG. 3 shows the invention of FIGS. 1 and 2, with the addition of tank 7. The bodies 1, and 2 have been rotated into a position where the angle between them may allow the scrubbing surface 8, rotational axis to occur at an angle that is generally greater than or less than 90 degrees to the surface to be cleaned. Scrubbing surface 8 may also have the characteristic of being absorbent, or able to hold fluid. The invention of FIG. 3 may also have a shear member, which may continuously or selectively contact the scrubbing/absorbent surface 8. Tank 7 may be a waste tank for receiving the waste fluid and or solids collected by scrubbing surface 8 and sheared by the shear from the scrubbing surface 8. Such a system of cleaning hard surfaces is disclosed in U.S. Pat. No. 5,657,503, U.S. Pat. No. 6,026,529, and U.S. Pat. No. 6,266,838 all by same applicant/inventor (Caruso) as this application and thus incorporated wholly into this application. As disclosed in the previous patents a variety of endless surfaces are contemplated for the present invention as well. If tank 7 is a waste-only tank, than the fluid used to clean the surfaces may be provided from a second source. Examples of such sources are spray bottles of cleaning fluid commercially available, ordinary water from a hose or faucet, or the steam from a steam-cleaning machine. Also contemplated is that tank 7 could also house a fresh fluid reservoir which could function much as the fresh fluid reservoirs of U.S. Pat. No. 5,657,503, U.S. Pat. No. 6,026,529, and U.S. Pat. No. 6,266,838 function. In addition to the way in which the invention of the previous patents operation is disclosed, it may be desirable to tie the dispensing of the fresh fluid into the movement of the endless surface 8, or equivalently/alternatively the activation of switch 4, or the switch that activates the driving motor of endless surface 8. And so switches and/or actuators could be added if so desired or deemed necessary. Additionally, the unit may be configured to act as an end effector for another machine such as a steam generator or vacuum. In this case, the invention may be attached, or coupled in some manner to the hose of the other contemplated machine. And obviously, the pivot ability of this unit is optional, in other words, the unit could be simply formed with the proper fixed angle(s).

So the invention in several embodiments may aid (through its scrubbing action) in the cleaning of surfaces in addition to the cleaning action that a solvent such as water or chemicals provide. It also may aid (through its scrubbing action) in the cleaning of surfaces in addition to the cleaning action that heated water, or steam may provide. In those embodiments where a shear is present the disclosed inventions may also serve to clean the scrubbing element 8, and optionally collect the waste or dirty fluids or solids. And if the unit were coupled to a vacuum or pump, the vacuum or pump source could function to collect the waste or dirty fluids or solids.

Referring again to FIG. 3, the bodies 1 and 2 have been rotated into a position where the angle between them may be less than 90 degrees. This allows the scrubbing surface 8, rotational axis to occur at an angle other than 90 degrees to the surface to be cleaned. When the endless pad surface 8 is not in contact with a surface to be cleaned, it may assume a generally flat orientation (not flexed at crease 9, not depicted). What this formed angle accomplishes is to create the greatest "lift" of the scrubbing surface from the surface to be cleaned for a given diameter. It also makes it so that the scrubbing surface may be confined to a smaller ring area or donut around the periphery of 8 than what can be seen in FIG. 4. Additionally, it is anticipated that other means may be provided for inducing the flexed orientation/area 9 of the endless pad surface 8 as seen in FIG. 3. However, if the user is responsible for inducing the flex in the pad it may give the user valuable feedback of the cleaning efficacy.

Figure 4:
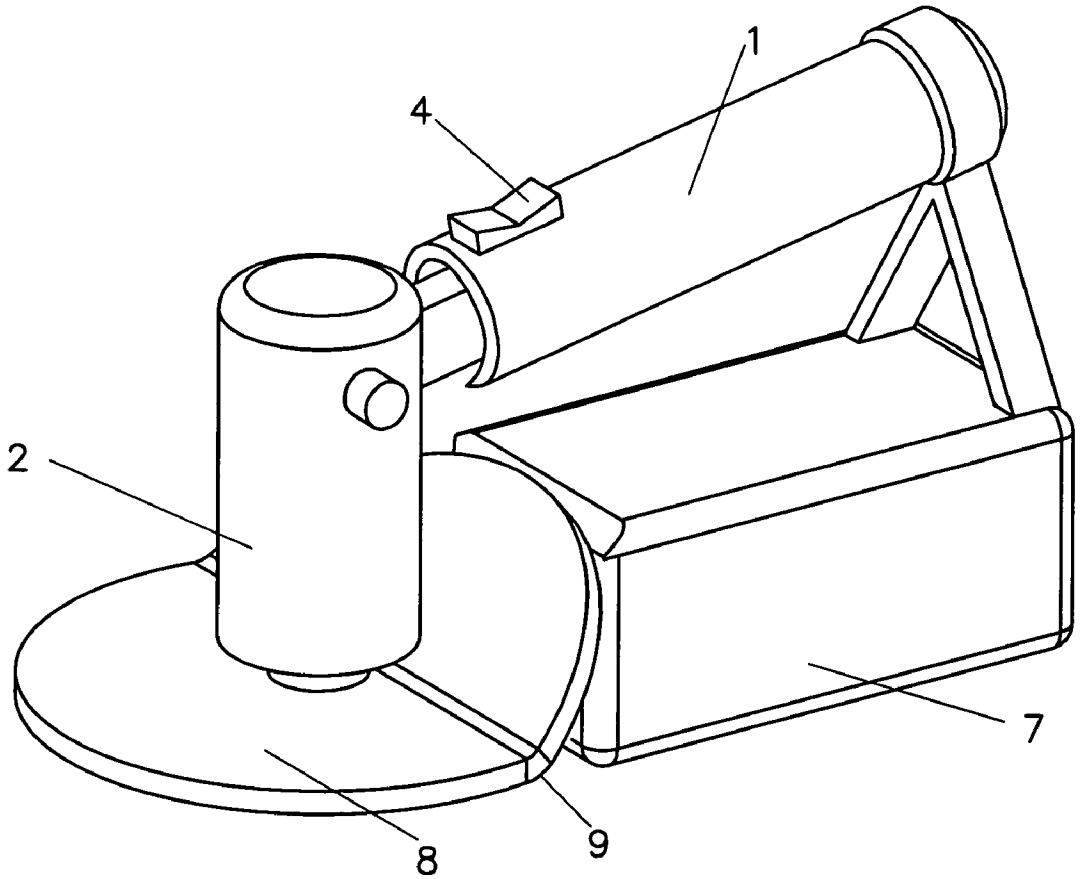
FIG. 4 is a trimetric view of another embodiment of the invention.

Contrast the situation of FIG. 3 with that of FIG. 4, which is also a contemplated embodiment. FIG. 4 shows that the scrubbing surface 8, rotational axis is adapted to occur at an angle generally 90 degrees to the surface to be cleaned. In this case the "lift" angle of the endless surface 8 is caused by the tank, or other means flexing the endless surface 8 upward indicated generally by flex area 9.

One aspect is of the adaptability of these tools are to utilize a versatile interface for the various implements or end effectors. Such an interface needs to be able to accommodate a variety of tools without having to use a complicated and costly chuck. It is common practice to use a round interface or stud on sanding pads and drums so that they may be used universally in the chucks of power drills. A chuck is an adjustable colleting system that can tighten down on and thus accommodate a variety of diameter rounds, such as drills, as well as the less commonly used, for drills, hex shanks.

It is also common practice to use a ¼ hex shank interface for power-screw drivers making them able to accommodate several types and styles of tool bits. These bits are intended for the driving of fasteners and drills for making holes.

Figure 5:
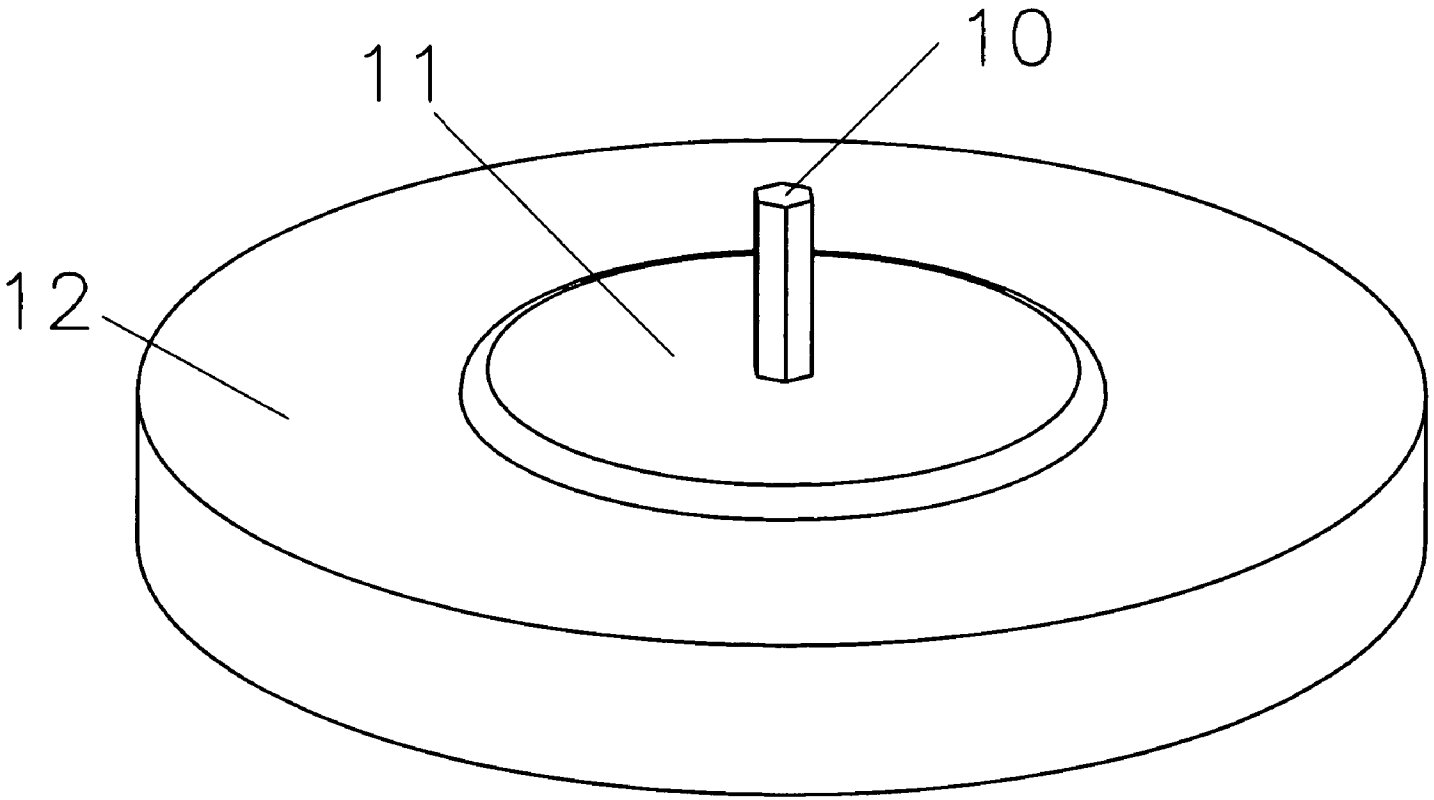
FIG. 5 is a trimetric view of another embodiment of the invention.
Figure 6:
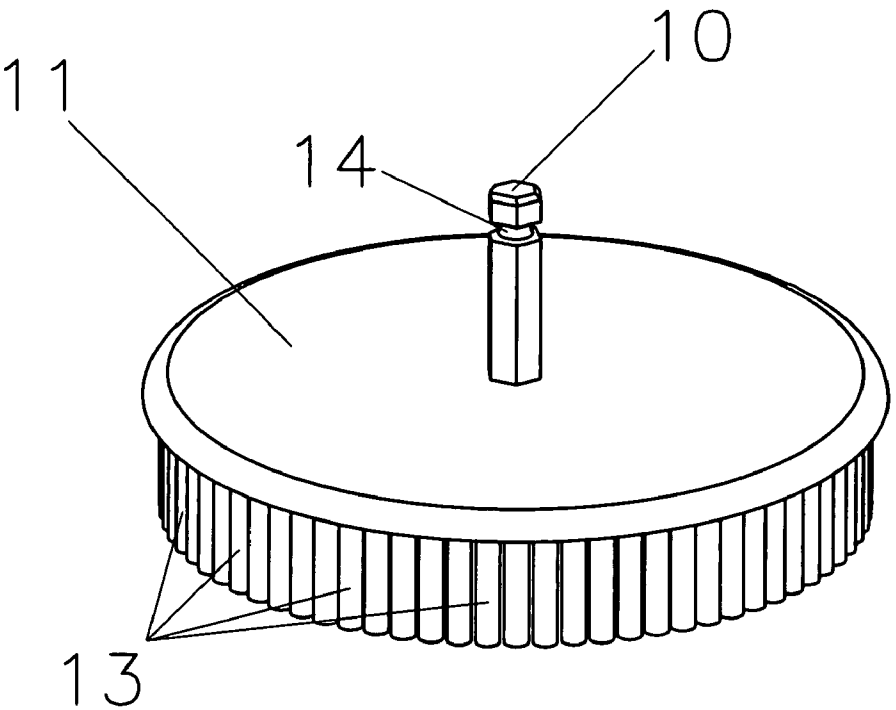
FIG. 6 is a trimetric view of another embodiment of the invention.
Figure 7:
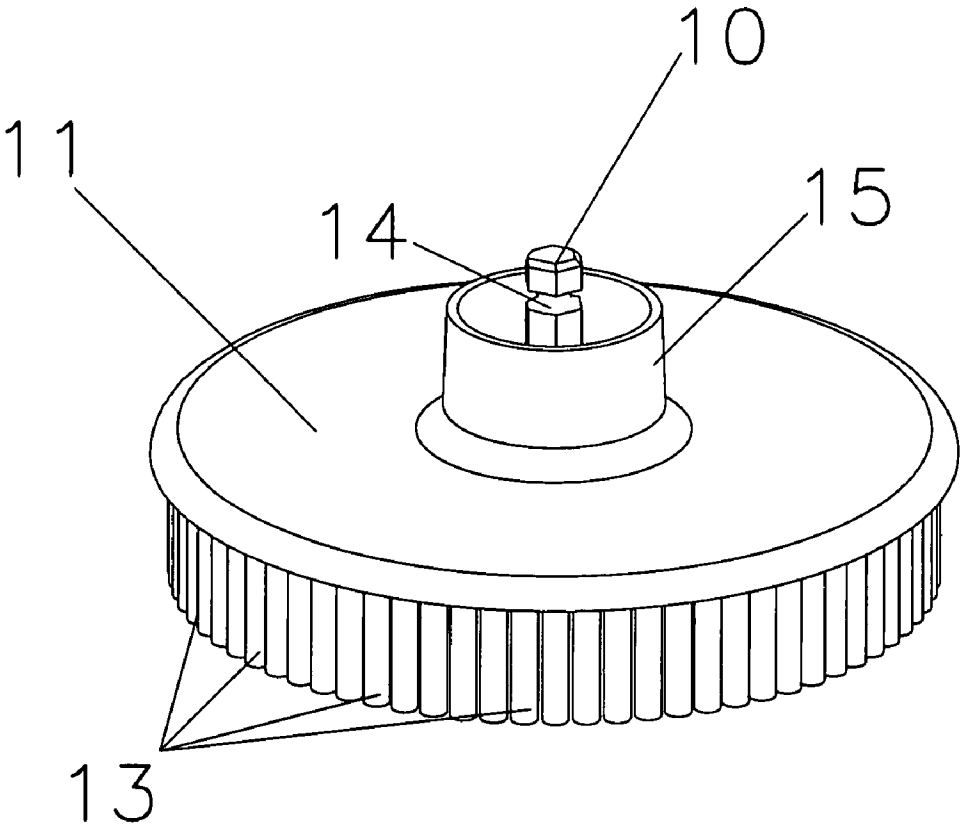
FIG. 7 is a trimetric view of another embodiment of the invention.

A new and novel approach is to equip end effectors such as scrubbers, brushes, polishing pads, scrubbers and sanders with a similar ¼" hex shank interface coupled to their backing pad or plate so that these end effectors may be used with power tools that can only accept ¼" hex shanks. Such a system would not only be valuable in a singular sense, but entire consolidated kits could be assembled, that could contain a power unit, with uniformly interchangeable scrubbers, brushes, polishers, bits, and drills. Referring to the embodiment of FIG. 5, such a shank 10, and the backing pad or plate 11, can be seen on scrubbing pad 12. The cleaning elements or sanding elements are affixed by one of several means to the backing pad/plate 11. Some methods of affixing the cleaning elements are adhesives; insert molding and the use of mechanical fasteners. The shank 10 and the backing pad/plate are then coupled together. One embodiment anticipates the shank 10 and the backing pad/plate being coupled by conventional manufacturing fastening means. Another embodiment anticipates the shank 10 and the backing pad/plate being one part formed from the same material and process such as plastic-molding or metal forming would yield. And so the hexagonal shaft interface and the backing pad/plate that supports the cleaning/sanding elements could be made of a homogeneous material. It should also be noted that the backing pad/plate might also assume a generally drum-like or cylindrical form. Referring to FIG. 7, it can be seen that an interface cup 15 may be integrated with the unit. Such a cup could be integral with the unit or a separate piece that is attached. Such a cup provides both functional and visual transition from the driven unit (backing pad/plate scrubber-abrader/bit) to its driver. Another way is that cup 15, may also serve to act as a shield or cover for some of the other elements. Yet another such way that a cup like or other structure would add to the end effectors functionality is that it would increase the rigidity of the coupled members. Referring to FIGS. 1 and 7, if the hexagonal shaft interface were to be made of a material such as plastic, the cup 15 would lend structural rigidity by its inner surface fitting well with the outer surface of rotatable shaft 3. Thus the hex shank is used primarily to transmit the required torque forces, and lateral forces may be shared between the hex shank and the inner face of the cup 15, and the outer surface of rotatable shaft 3.

Figure 9:
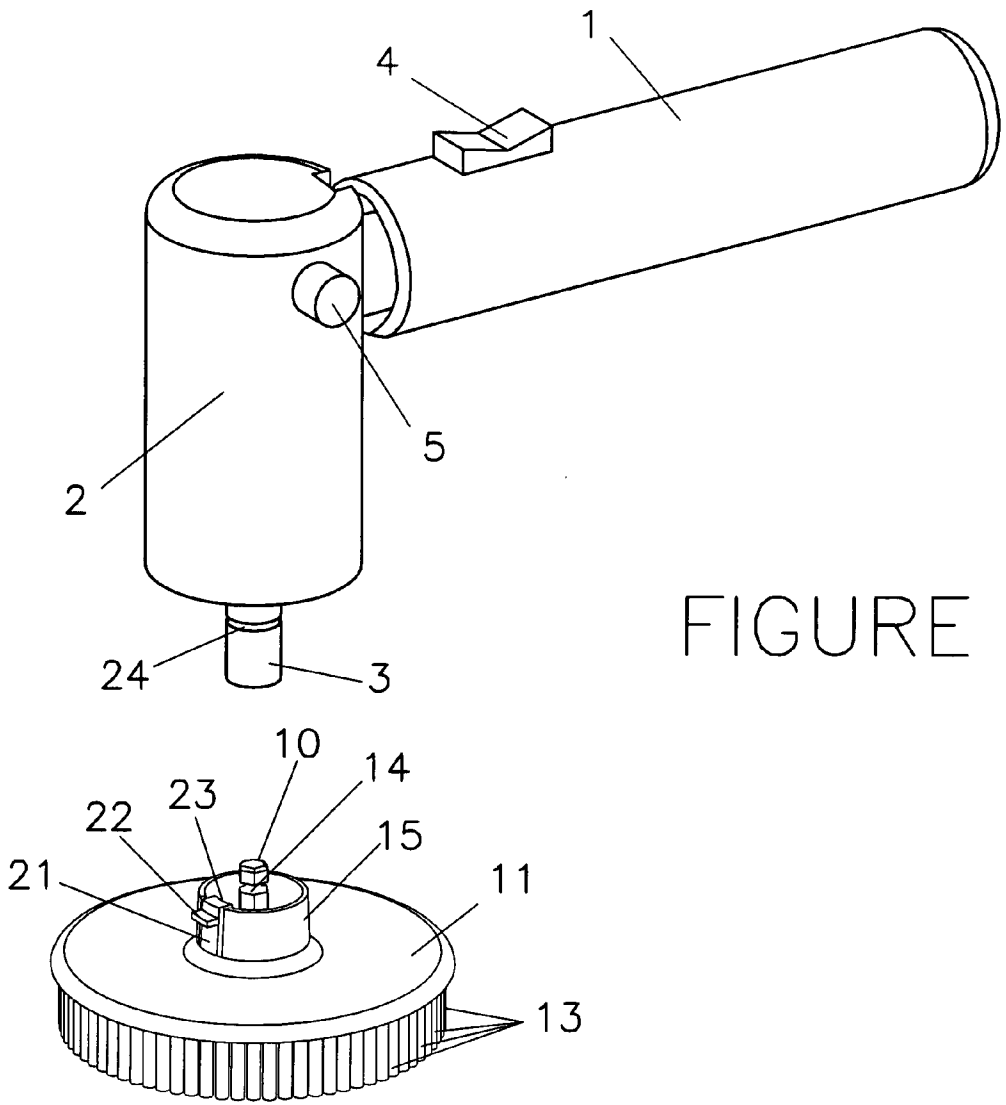
FIG. 9 is a trimetric view of another embodiment of the invention.

Another such way that a cup like or other structure would add to the overall structures functionality is that it may act as a locking device for retaining the pad/brush/buffer/sander end effector to the power-head. As previously discussed, in some cases it is desirous to lock the end effector or bit to the rotatable shaft 3 in a more positive way. Referring to FIG. 9 a novel means for locking can be appreciated. The exterior surface of rotatable shaft 3 is provided with a groove 24, or other such feature. The cup 15, or other part of the end effector may be provided with a locking tab 21, which has a locking tooth/tab/pawl 23 which may actively engage groove 24. Such a tab 21 may also have a finger grip 22, so that the user may actively engage or disengage the tooth/tab/pawl 23. Such an assembly could be achieved from the assembly of several parts, or preferably locking tab feature 21 could be integrally formed with other elements. For example, the backing plate 11, hex shaft 10, and cup 15 with its locking features 21-23, could all be formed together by injection molding them out of plastic. Such a locking interface could be also be used on bits that may already have a hex shank. One example of this is a chuck for drill bits that has been equipped with a hex shank. A cup 15 and its locking features 21-23, could be attached to such a chuck and thus give a clean approach to locking the chuck to the power head. An important distinction between this disclosed retention method and those previously referred to, is that the retention method is external to the hex receiving shank of the power head, which has several distinct advantages. The lock is stronger, more positive, and accessible to the user. So several locking means are contemplated.

Another contemplated embodiment is where the power tool kit is equipped with an interface that is capable of directly receiving an end effector such as a scrubber or sander which does not have a ¼" hex shank, and so also contemplated would be providing an adapter/converter interface that makes it so that the tools initial interface may be converted to then use the commonly used ¼" hex shank. This separate adapter could have an appropriate interface for holding the brush/pad/bit or other tool on one end and a ¼" hex shank on its opposite end for attachment to the power tool.

Figure 8:
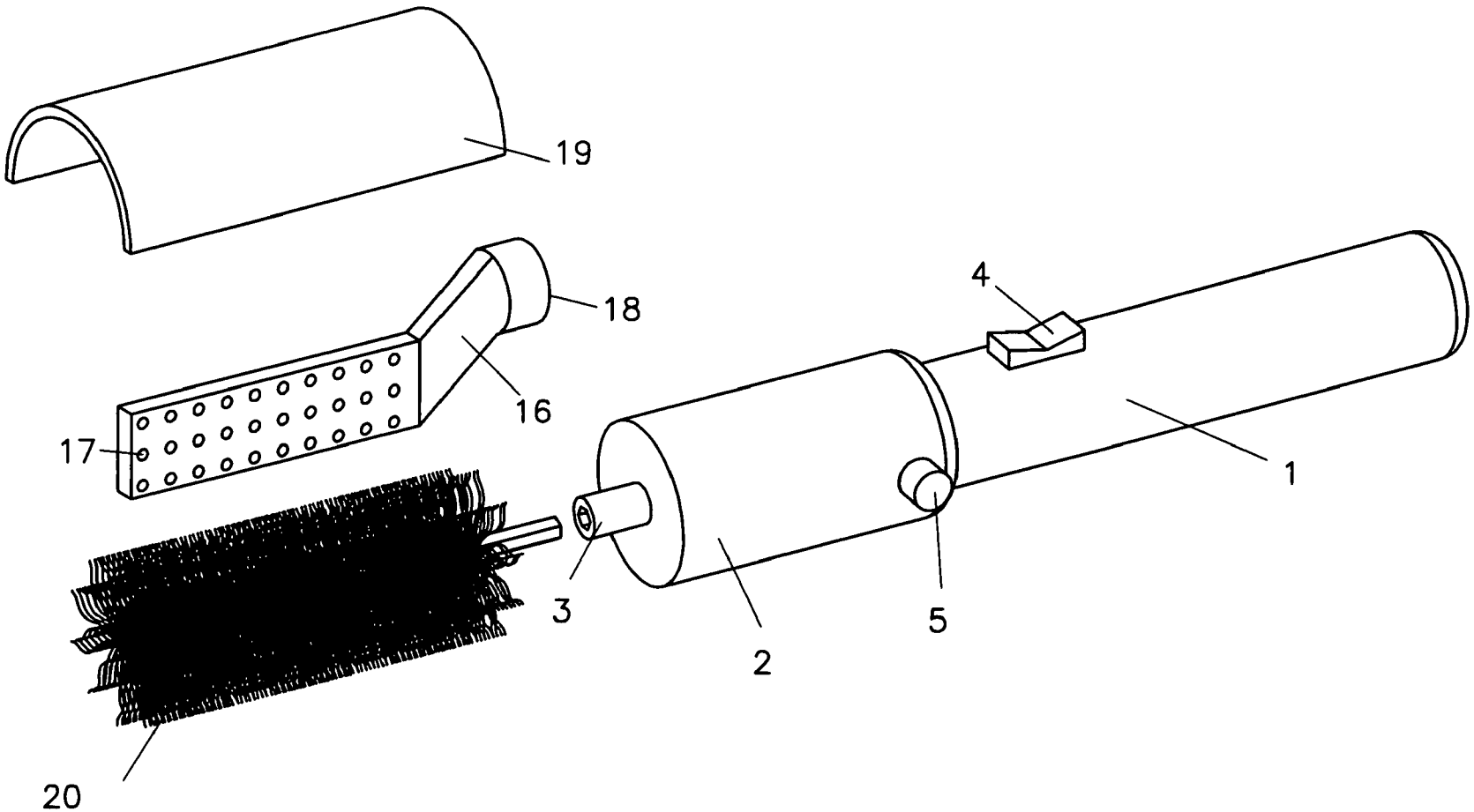
FIG. 8 is a trimetric view of another embodiment of the invention.

Referring to FIG. 8, another embodiment of the present invention may be appreciated. Reference characters 1-5 and their function have already been discussed. Item 20 is a brush that may be composed of fairly flexible fibers like one would find incorporated into a duster. Such dusters are commonly made from feathers based fibers, lambs wool based fibers, or plastic based fibers. It has also been found that the fibers may be made from threads, woven or not, that for sake of illustration are substantially similar to the fringe on an area rug. Such fibers can be made from a variety of materials from cotton to again nylon. However, it has been found that synthetics such as nylon do have greater static-electricity-charging capabilities. An important distinction needs to be drawn regarding the differences between the geometry and functionality of dusters fibers, and the bristles of a brush. The way in which a dusters fibers function is as the relatively flexible fibers come into contact with a surface to be cleaned, the length of the fiber's sides grab the dust or debris. Contrast this with the action of brush rolls on a vacuum cleaner, or a household broom. In these situations it is the ends of relatively stiff bristles that serve to flick or brush directionally the debris. And so the sides of the fibers have no functionality except to geometrically connect the ends of the brush elements to the rest of the device, and to flex only enough for the flicking action and to compensate for surface interference. So the fibers we are dealing with are relatively flexible so that extremely little force is required to cause their lengths to flatten against the surface to be cleaned, as opposed to the types of bristles used in traditional brush-rolls and the like. Another related distinction between traditional brush rolls on a vacuum cleaner, and the disclosed duster, is regarding the length of the cleaning elements. The effective length of the bristles used in brush rolls is generally ½" or less. Whereas some embodiments of the disclosed duster have fibers greater than 1". Again this goes to flexibility, so that the sides of the fibers are used for cleaning. And this flexibility is also required when to conform to irregular surfaces (such as picture frames, piano keys, glass ware and the like) without pushing these very same objects around.

Again, referring to FIG. 8, item 16 is a dust conduit which has air inlets 17 and an air outlet 18 which is intended to be connected in fluid communication with a vacuum air pump. Such a vacuum air pump could either be an integral part of the invention, or a separate source of vacuum, which may be in fluid communication with the invention. The area forward of the air outlet 18, towards the dusting brush, generally defines a handgrip area. Item 19 is a shield which may also have air inlets 17 and outlets 18 associated with it. The operation of the device is as follows. Brush/duster 20 is rotatably mounted to 3 possibly by one of the various means already disclosed. The duster-brush may optionally be configured so that its axis of rotation may be disposed generally in-line with the handle 1 of the powering unit, or optionally at a variety of angles. Vacuum conduit 16, is either in close proximity to brush duster 20 so that dust and debris may be removed from brush duster 20 by a vacuum air pump, or vacuum conduit is in active frictional engagement with the fibers of brush duster 20 so that vacuum conduit 16 acts as a comb or shear to loosen the dust and debris from brush duster 20 so that the vacuum air pump may then completely remove the dust and debris from the area. Active frictional engagement may also reduce the amount of negative vacuum pressure necessary to remove the debris from the fibers. Centrifugal force, caused by the spinning action of the brush/duster, may also aid in bringing the fibers or pick-up elements of the brush/duster into the air flow region of the device, or into the active frictional engagement that has already been described. The movement of the brush/duster may be continuous while cleaning or intermittent with the user only pulsing the unit on for intermittent cleaning of the duster. And so speed of rotation is not very critical, in other words the movement of the duster can be quite slow, however, it has been found that the user feels it is working best when it is moving at least 20 rpm. It should also be appreciated that if the duster moves too quickly, the flailing of the fibers can fan dust away before it has been picked up. This generally seems to occur at speeds greater than 250 rpm. Switch 4, may be reversible, as has been previously described, to further aid in the versatility of the units cleaning ability. Additionally, 20 may have a static charge imparted on it throughout the process via frictional or electrically driven means. Applicant Caruso has previously disclosed this technology in U.S. application Ser. No. 09/963,954, and so this referenced application is to be incorporated herein in its entirety.

Figure 10:
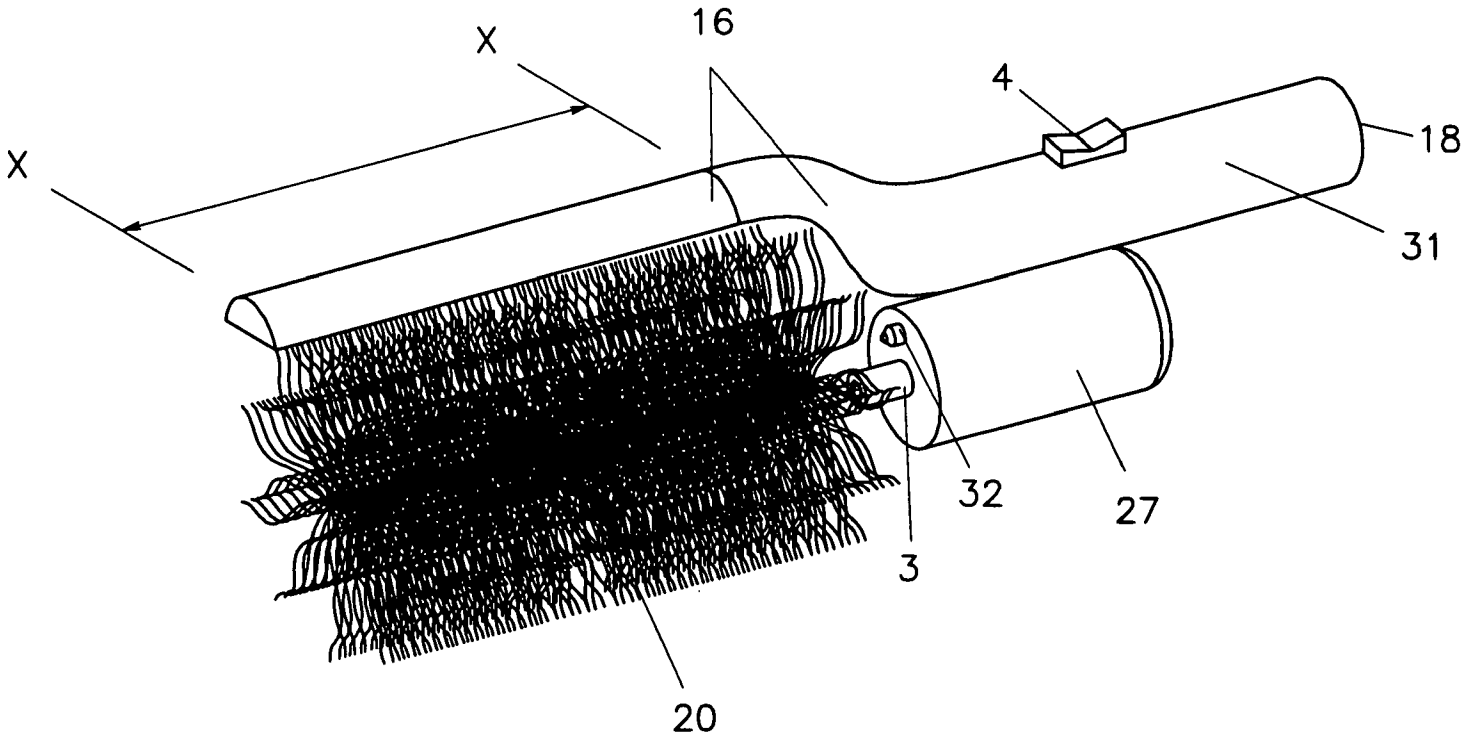
FIG. 10 is a trimetric view of another embodiment of the invention.

Vacuum inlet orifice/orifices 17 may take many forms. One such alternate form is as a continuous slot on the underside of 16. 19 is a shield that may be used in conjunction with 16, or instead of air conduit 16. It may function simply as a shield or alternatively as the air conduit (instead of 16) or as an additional air conduit in addition to air conduit 16. Obviously, if it 19, is to function as an air conduit, it would have appropriate inlet/outlet means associated with it. It, the shield 19, may also act as a shear or combing element for the brush duster 20 to rub against rotationally, thus knocking of debris and dust and potentially imparting a static charge. FIG. 10 is similar to the device depicted in FIG. 8, with some minor differences. Body 1, which forms the conduit 16, also creates or forms the handle or hand grip for the user. And so the air that enters the holes or orifice 17, not shown, travels through conduit 16 and out outlet 18. Outlet 18 may be formed as a tapered female connection that is a standard in the industry. Such connections are generally about 1.25 inches in diameter with a slight taper of 1-1.5 degrees, so that the end cuff or junction of a vacuum hose may be coupled to various end-effectors. Optionally, outlet 18 may have an integral hose, or other continuing conduit connected. And as before, body elements 31 or other could house batteries. Another feature that can be seen in FIG. 10 is a lighting source 32. Such a lighting source could be of conventional incandescent, halogen, or light emitting diode variety. The light source could be activated by switch 4, or by a separate switch, which is not shown. The light source could be illuminated continuously, while the unit is on, illuminating the area to be cleaned, or it may intermittently flash like a strobe, giving the user an added sense of cleaning efficacy.

Figure 11:
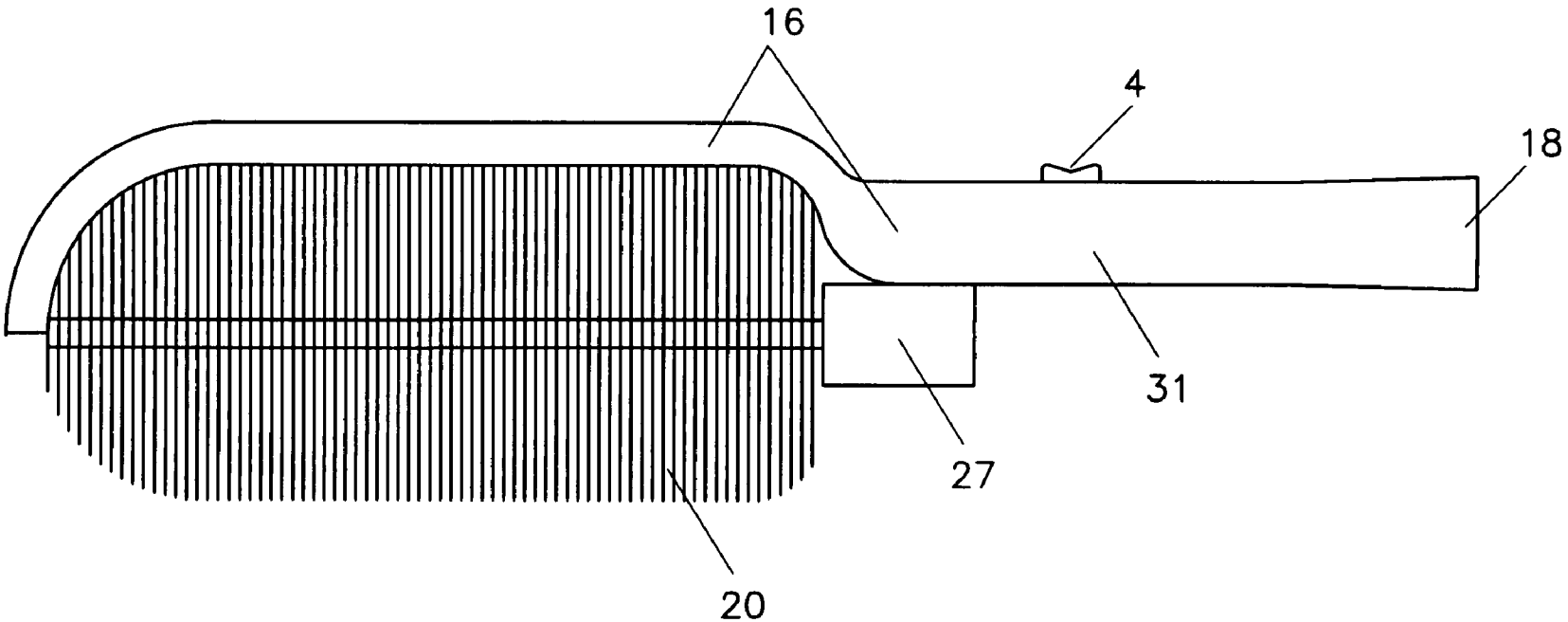
FIG. 11 is a side elevational view of another embodiment of the invention.

Referring now to FIG. 11, which is a side view of a device, which is substantially the same as the device of FIG. 10. Here it can be seen that it may be advantageous to curve conduit 16 to closely follow the shape of the duster-brush 20.

Figure 12:
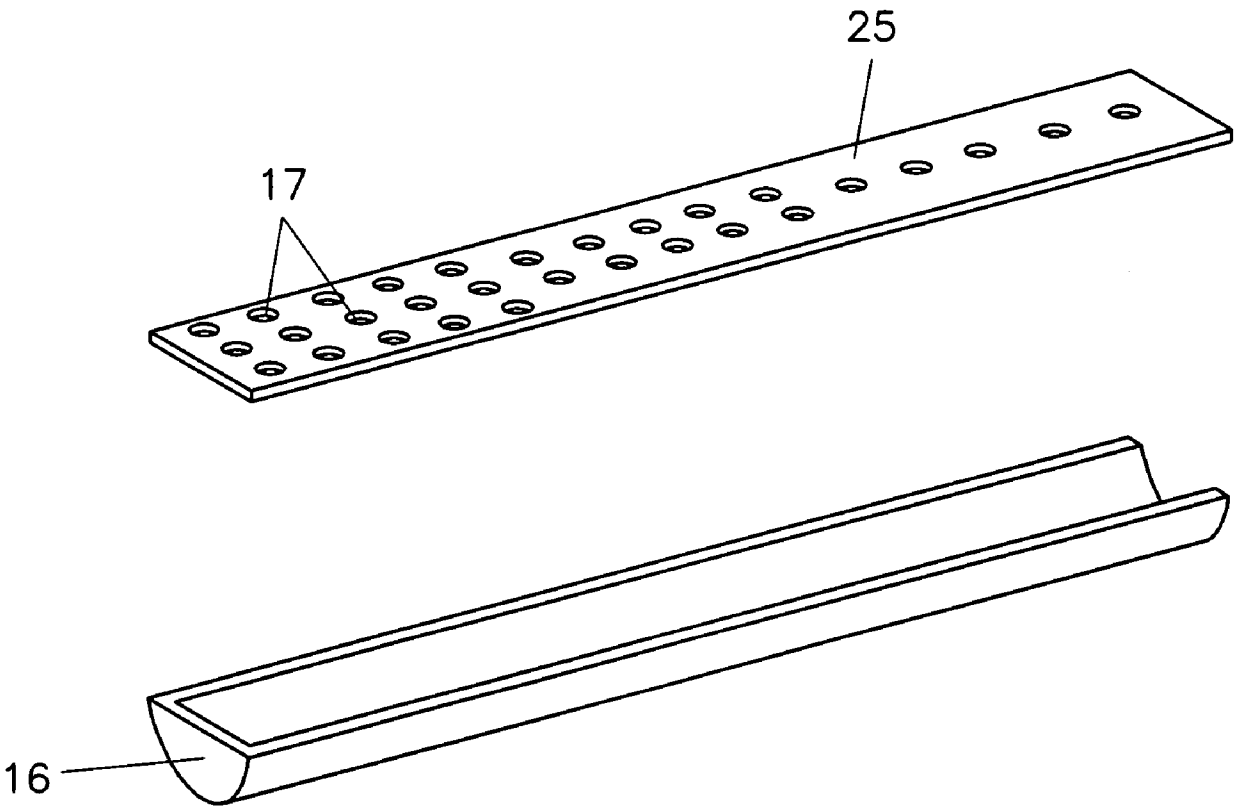
FIG. 12 is a trimetric view of another embodiment of the invention.

Referring now to FIG. 12, which is a flipped section of conduit 16 of FIG. 10, located generally between X-X in FIG. 10. The section has been flipped for clarity. In this view face 25, which faces the duster, can be seen. This face 25, may be made as part of the conduit 16, or as depicted for clarity, as a separate piece. Apertures, or holes 17, can be seen as tapering in density from one end to the opposite end. The reason for this is that in order to provide an even distribution of airflow, and thus properly clean the end of the brush-duster, the area closest to the air outlet 18, needs to be more restrictive than the area furthest from outlet 18. Fluid dynamics makes it so that the flow of air will always seek the shortest path, or that of least resistance. So, by making the shortest path higher in resistance, flow is evened out throughout the length of the conduit in its perforated area.

Figure 13:
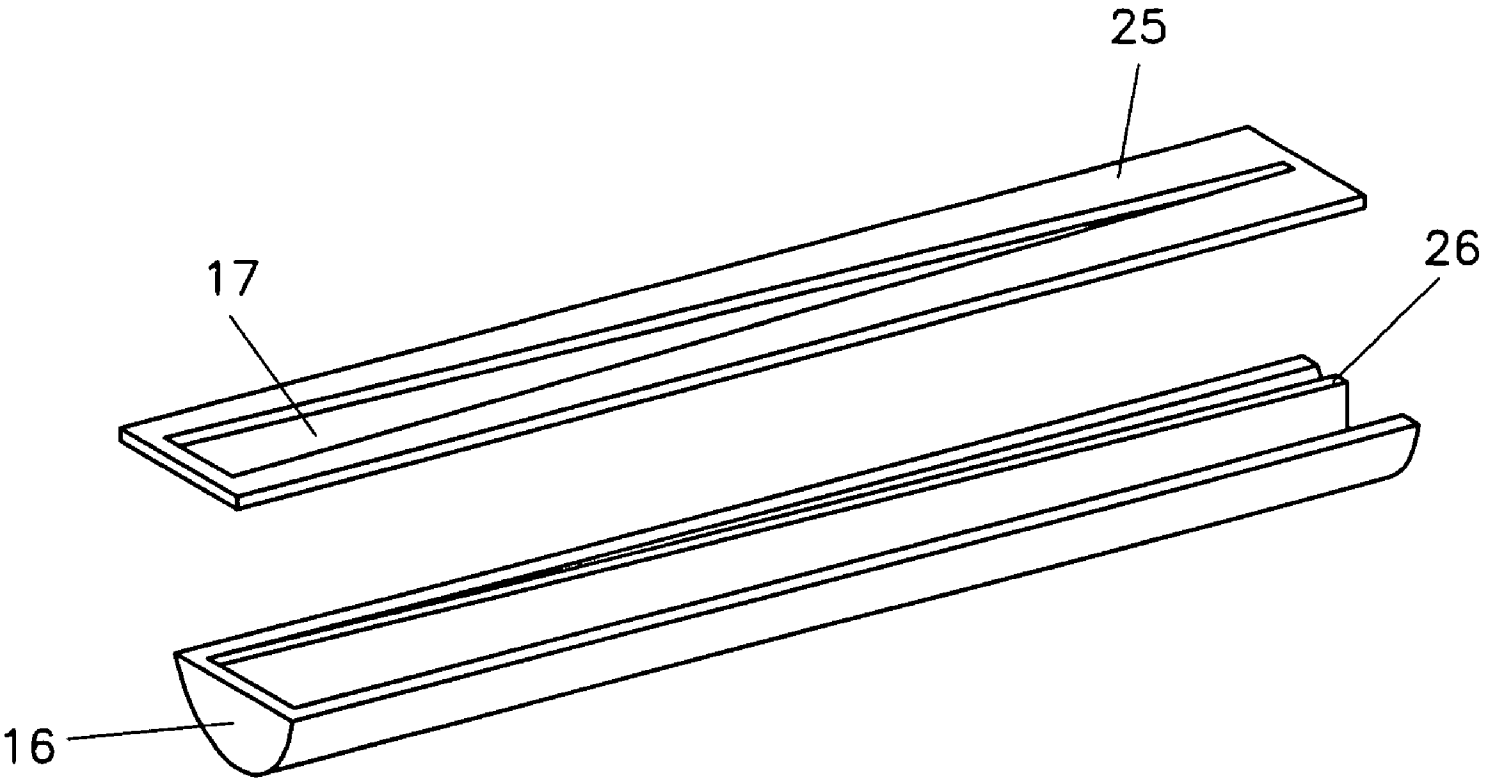
FIG. 13 is a trimetric view of another embodiment of the invention.

Referring to FIG. 13, another configuration of face 25 can be seen. In this configuration, a single variable slot 17, replaces the variable density holes of FIG. 12. Obviously, this orifice could optionally be comprised of more than one slot and still fall within the spirit and scope of the invention. Another way of accomplishing this is also illustrated here. Through internal baffling 26, the interior of conduit 16 is the narrowest in the perforated area closest to air outlet 18. Similarly, it is possible to make the entire conduit 16; narrow as it transitions from one end to the perforated area closer to air outlet 18, however this may not be aesthetically desirable.

Figure 14:
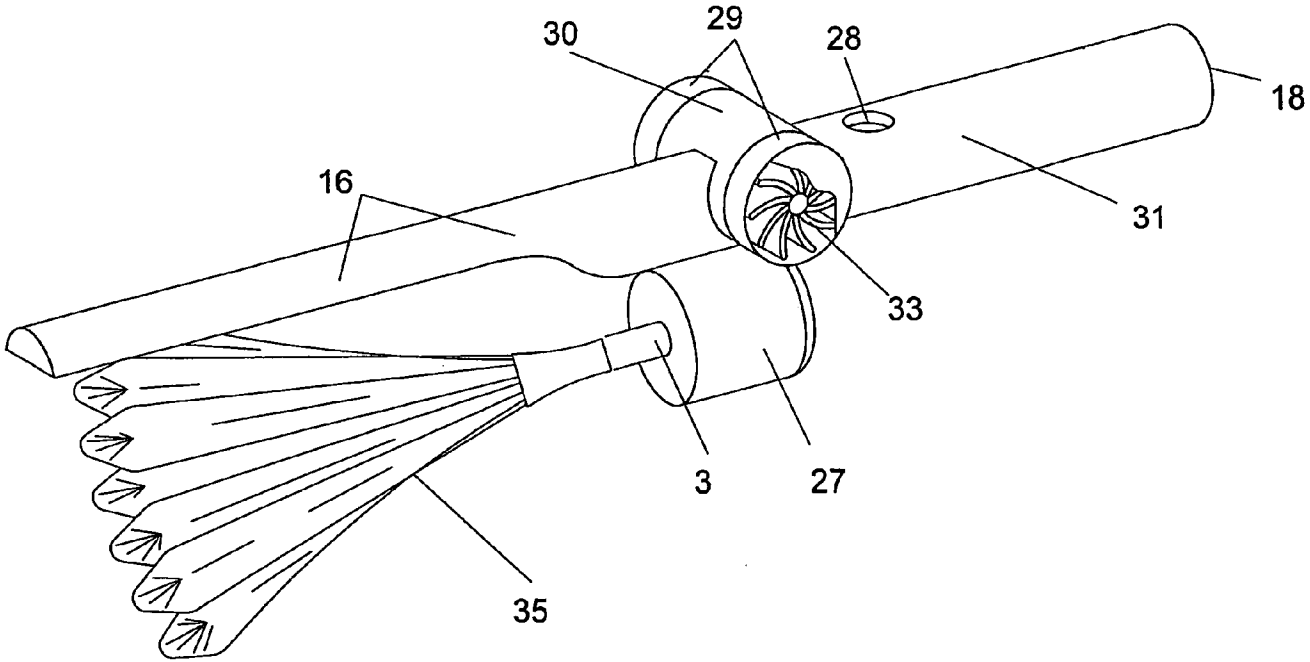
FIG. 14 is a trimetric view of another embodiment of the invention.

Referring now to FIG. 14, another embodiment may be seen. Many of the features are shared with previous embodiments. Of note, are the swivel construction, and its integration with an air turbine unit 33. Swivel caps 29 are part of or attached to tubular body 31. Center swivel 30, is part of or attached to conduit 16, and reduction drive unit 27. So, tubular body 31 can swivel angularly relative to center swivel 30, and air conduit 16, gear reduction drive 27, and duster brush 20. An air turbine is located within center swivel 30, and is actively coupled to reduction drive unit 27. A sliding airflow junction (not shown) makes it so that airflow is maintained throughout the conduit from 16, through 31, regardless of their relative angular orientation. Obviously, the swivel caps 29 could have been constructed as part of conduit 16, in which case, center swivel would have been part of tubular body 31. 28, is a bleeder air valve for controlling the unit. It is depicted as a simple hole that the user may place their thumb or other finger over to activate the unit. When not covered, air is allowed to enter, thus bypassing the turbine, located generally within center swivel 30, causing the brush not to rotate even though the vacuum source may still be on. Such a valve could be constructed in many ways other than a simple hole. A poppet valve or other construction could yield a cleaner approach. Another approach, which is contemplated, is to incorporate a brake type switch that would effectively lock the turbine or some part of the reduction drive, thus stopping the brush from spinning. And yet another contemplated approach is to de-couple the drive from the brush duster. This could be accomplished at any point along the drive train system, from decoupling the turbine, decoupling a transfer and or reduction belt (s), decoupling a transfer and or reduction gear(s), or decoupling the final shaft 3. In the embodiment of FIG. 14, the duster 35 is a feather duster.

Additional control is anticipated in that a switch, not shown, may be used to control the final rotation of shaft 3 making it reversible, as was the case in previous electrically based embodiments. And so the user would be able to control the direction of rotation of shaft 3. This would be accomplished by coupling such a switch to a reversing gear(s)/belt(s) arrangement within the drive train. Preferably such a reversing scenario would occur as close to the final out put as possible. The reason for this is that the lower speeds encountered would reduce the amount of "gear-gnash" when changing or engaging the drive. This switch could also have a neutral position, thus accomplishing the decoupling already described for de-powering the brush even if airflow is still present.

Figure 15:
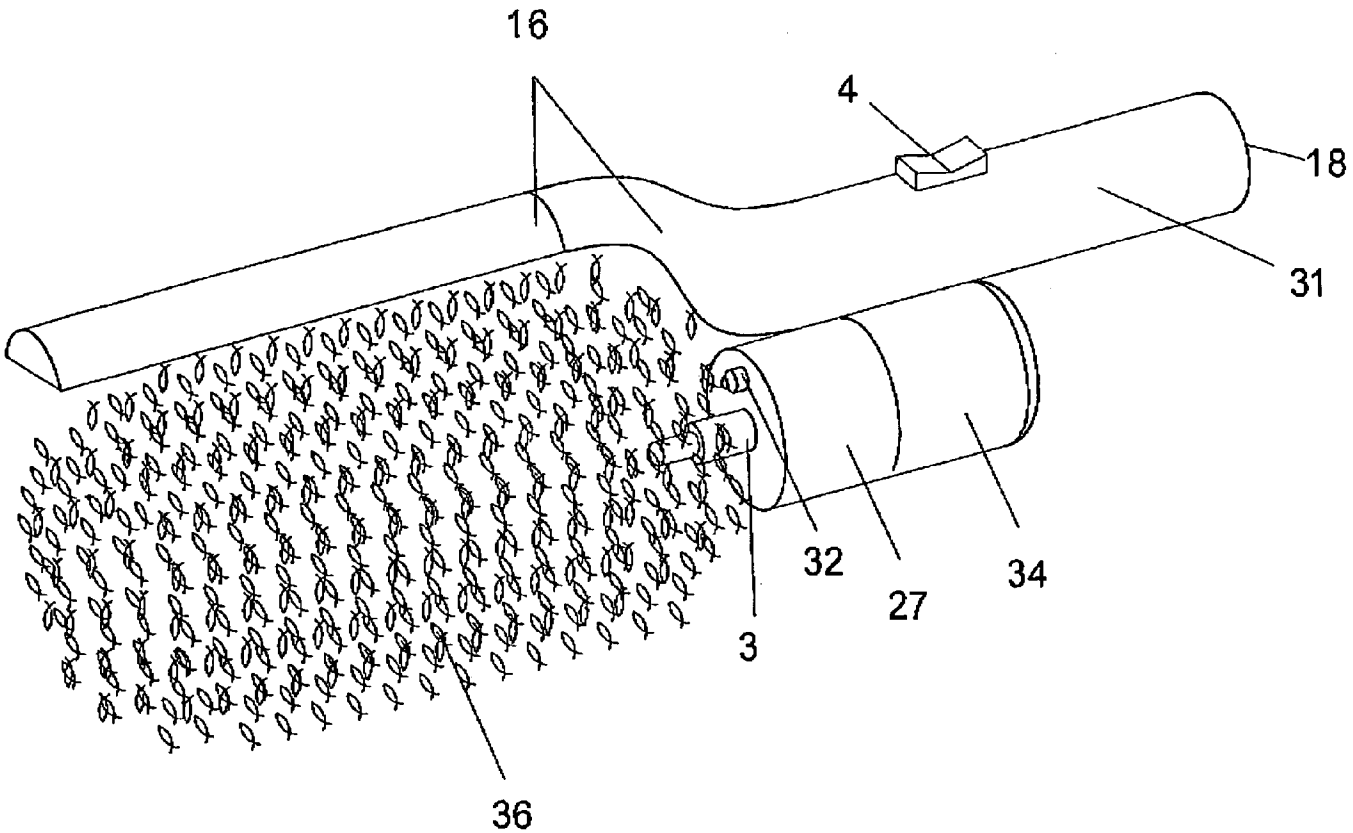
FIG. 15 is a view, similar to FIG. 10, of another embodiment of the invention.

FIG. 15 is similar to FIG. 10, but shows a lamb's wool duster 36 and a single canister containing an electric motor 34 and a gear reduction unit 27.

Again, all previously described embodiments may be powered through conventional means such as a motor and associated gearing and/or belt drives. The motor could be electrical in nature, a mechanical wind-up spring driven motor, or an air-turbine motor powered by an on board or separate, external air movement device such as a vacuum fan. And so a variety of novel tools, end effectors and interfaces between the two have been disclosed.

I claim:

1. A hand held device for dusting surfaces, the device comprising:

A. an axially elongated housing having a first end, a second end, and a center section;

B. a drive associated with said housing;

C. a generally cylindrical rotating duster having a first end, an axially spaced second end, and an axis of rotation, at least one of its first end and its second end being coupled to said drive; and D. a conduit extending from said first end of said housing to said second end of said duster, wherein said conduit has an inlet and an outlet, wherein said inlet is disposed generally in a parallel relationship with said duster and is configured to have a tapered air flow pattern.

2. The device of claim 1, where said first end is coupled to said drive.

3. The device of claim 1, wherein said housing defines a handgrip.

4. The device of claim 3, wherein said handgrip further includes a drive control.

5. The device of claim 1, wherein said drive is an air turbine motor.

6. The device of claim 1, wherein said drive is an electric motor.

7. The device of claim 6, further comprising a reduction drive arrangement, actively coupling said drive motor to said duster.

8. The device of claim 1, further including a battery compartment.

9. The device of claim 1, wherein said duster comprises highly flexible nylon fibers.

10. The device of claim 1, wherein said duster comprises feathers.

11. The device of claim 1, wherein said duster comprises lambs wool.

12. The device of claim 1, wherein said housing defines a handgrip.

13. The device of claim 12, wherein said handgrip further includes a drive control to control the speed of said drive.

14. The device of claim 1, wherein said drive is an air turbine motor.

15. The device of claim 1, wherein said drive is an electric motor.

16. The device of claim 1, further comprising a reduction drive arrangement, actively coupling said drive motor to said duster.

17. The device of claim 1, wherein said duster comprises highly flexible nylon fibers.

18. A hand held device for cleaning surfaces, the device comprising:

A. a housing, having a first end, a second end, and a center section;

B. a drive associated with said housing;

C. a duster;

D. a conduit extending from said first end of said housing to said second end of said duster, wherein said conduit has an inlet and an outlet, wherein said inlet is disposed generally in line with said duster and is configured to have a tapered air flow pattern; and E. a reduction drive arrangement, reductively coupling said drive motor to said duster.

19. The device of claim 18, wherein said housing defines a handgrip.

20. A hand held device for cleaning the dust from surfaces, the device comprising:

A. a housing;

B. a motive drive associated with said housing;

C. a duster coupled to said motive drive;

D. a generally planar surface extending from said housing and in frictional contact with said duster;

E. a vacuum port in said generally planar surface; and

F. a reduction drive arrangement, whereby said drive motor is reductively coupled to said duster.

21. The device of claim 20, wherein said housing defines a handgrip.

22. The device of claim 21, wherein said handgrip further includes a drive control to control the speed of said drive.

23. The device of claim 21, wherein said drive is an air turbine motor.

24. The device of claim 20, wherein said drive is an electric motor.

25. The device of claim 20, wherein said duster comprises highly flexible nylon fibers.

* * * * *